US011313319B2

(12) United States Patent
Kashima et al.

(10) Patent No.: US 11,313,319 B2
(45) Date of Patent: Apr. 26, 2022

(54) ENGINE

(71) Applicant: HONDA MOTOR CO., LTD., Tokyo (JP)

(72) Inventors: Soji Kashima, Saitama (JP); Toshiro Kiura, Saitama (JP); Kota Tokubi, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/982,816

(22) PCT Filed: Mar. 30, 2018

(86) PCT No.: PCT/JP2018/013832
§ 371 (c)(1),
(2) Date: Sep. 21, 2020

(87) PCT Pub. No.: WO2019/187079
PCT Pub. Date: Oct. 3, 2019

(65) Prior Publication Data

US 2021/0054805 A1 Feb. 25, 2021

(51) Int. Cl.
*F02F 7/00* (2006.01)

(52) U.S. Cl.
CPC ..... *F02F 7/006* (2013.01); *F02F 7/0043* (2013.01); *F02F 7/0068* (2013.01)

(58) Field of Classification Search
CPC ..... F02F 7/0043; F02F 7/0068; F02F 7/0004; F02F 7/00; F02F 7/0026; F02F 1/002; F01L 1/18; F01L 1/047; F01L 1/146; F01L 1/14
See application file for complete search history.

(56) References Cited

U.S. PATENT DOCUMENTS 4,426,964 A * 1/1984 Umeda ..... F01M 9/06 123/195 A
4,727,834 A * 3/1988 Isaka ..... F01M 9/06 123/196 CP (Continued)

FOREIGN PATENT DOCUMENTS

CN 102644521 A 8/2012
JP 2004-060453 A 2/2004

(Continued)

OTHER PUBLICATIONS

Jun. 19, 2018, International Search Report issued for related PCT Application No. PCT/JP2018/013832.

(Continued)

*Primary Examiner* — Grant Moubry
(74) *Attorney, Agent, or Firm* — Paratus Law Group, PLLC

(57) ABSTRACT

An engine (E) includes a crankcase body (19) including a bottom plate (19*a*) and a tubular portion (19*c*), a crankcase cover (20) covering a case opening portion (19*b*) of the crankcase body (19), a crankshaft (2), a cylinder base portion (21*a*) located inside the crankcase body (19), a cylinder block (21*b*) located outside the crankcase body (19), and a camshaft (25) located inside the crankcase body (19) and between the bottom plate (19*a*) and cylinder base portion (21*a*). The crankcase body (19) has the bottom plate (19*a*) detachably attached to the tubular portion (19*c*).

5 Claims, 8 Drawing Sheets

(56) References Cited

U.S. PATENT DOCUMENTS 4,790,273 A * 12/1988 Oguri ..... F01M 9/06 123/195 HC
4,964,378 A * 10/1990 Tamba ..... F01P 5/06 123/41.42
6,213,079 B1 * 4/2001 Watanabe ..... F02B 63/02 123/196 R
6,213,081 B1 * 4/2001 Ryu ..... F01M 9/06 123/196 W
6,647,962 B2 * 11/2003 Kuroda ..... F01L 1/267 123/432
6,938,600 B2 * 9/2005 Rotter ..... F01L 13/085 123/182.1
7,201,132 B2 * 4/2007 Miyake ..... F01M 1/04 123/195 HC
8,408,882 B2 * 4/2013 Klika ..... F04B 17/05 417/364
2002/0043236 A1 4/2002 Araki
2003/0041834 A1 3/2003 Kawakubo et al.
2004/0000285 A1 1/2004 Bonde et al.
2004/0094113 A1 5/2004 Honda et al.
2005/0109304 A1 * 5/2005 Rotter ..... F01L 13/085 123/182.1
2007/0119404 A1 5/2007 Yuasa et al.
2008/0202483 A1 * 8/2008 Procknow ..... F01M 13/04 123/572
2012/0073527 A1 3/2012 Oltmans et al.
2014/0076268 A1 * 3/2014 Furuya ..... F02F 7/0053 123/197.4
2017/0260880 A1 9/2017 Kono

FOREIGN PATENT DOCUMENTS

JP 2017-160833 A 9/2017
JP 2017-214883 A 12/2017

OTHER PUBLICATIONS

Jun. 19, 2018, International Search Opinion issued for related PCT Application No. PCT/JP2018/013832.
Aug. 27, 2021, Chinese Office Action issued for related CN application No. 201880091005.6.
Jan. 4, 2022, European Communication issued for related EP Application No. 18912664.2.

* cited by examiner

ENGINE

CROSS REFERENCE TO PRIOR APPLICATION

This application is a National Stage Patent Application of PCT International Patent Application No. PCT/JP2018/013832 (filed on Mar. 30, 2018) under 35 U.S.C. § 371, which is hereby incorporated by reference in their entirety.

TECHNICAL FIELD

The present invention relates to an engine which can be mounted on a working machine such as a lawn mower or a high pressure washer.

BACKGROUND ART

Generally, an engine includes a crankcase having first and second bearing portions which support both ends of a crankshaft and a cylinder into which a piston is fitted. For example, Patent Literature 1 discloses an engine in which a crankcase is formed of first and second case half bodies which are joined to each other at a dividing surface which diagonally intersects axes of first and second bearing portions and a cylinder and the first bearing portion are integrally formed on the first case half body, and further the second bearing portion is integrally formed on the second case half body.

Related Art Literature

Patent Literature

Patent Literature 1: JP-A 2017-160833

SUMMARY OF THE INVENTION

Problem that the Invention is to Solve

However, in the engine structure of Patent Literature 1, there is room for improvement in workability during maintenance because the first and second case half bodies are divided by the dividing surface which diagonally intersects.

The invention provides an engine having excellent workability during maintenance.

Means for Solving the Problem

The invention is an engine which includes:

a crankcase body including a bottom plate including a first crankshaft insertion hole and a tubular portion including a case opening portion on an opposite side to the bottom plate;

a crankcase cover including a second crankshaft insertion hole and covering the case opening portion of the crankcase body;

a crankshaft which is inserted into the first crankshaft insertion hole and the second crankshaft insertion hole;

a cylinder base portion located inside the crankcase body;

a cylinder block located outside the crankcase body; and a camshaft disposed inside the crankcase body and between the bottom plate and the cylinder base portion, where the crankcase body has the bottom plate detachably attached to the tubular portion.

Advantages of the Invention

According to the invention, the crankcase body has the bottom plate detachably attached to the tubular portion. Therefore, by removing the bottom plate from the tubular portion during maintenance, it is possible to easily replace the camshaft inside the crankcase without removing the crankshaft.

MODE FOR CARRYING OUT THE INVENTION

Figure 1:
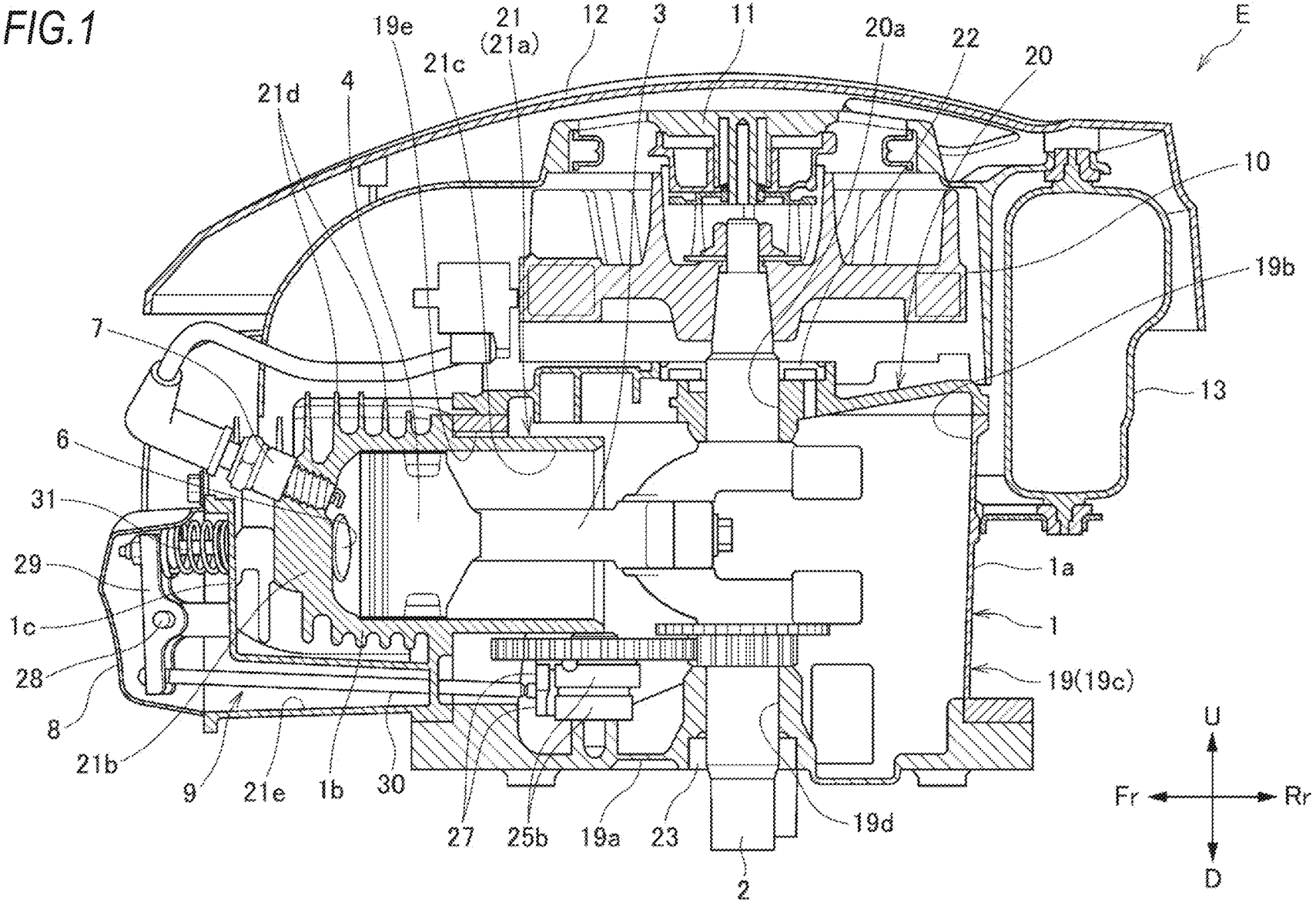
FIG. 1 is a cross-sectional view of an engine according to an embodiment of the invention.

Hereinafter, an embodiment of the invention will be described with reference to FIGS. 1 to 8. An engine E of the embodiment is a small general-purpose engine mounted on a walk-type lawnmower or the like and constitutes an OHV engine. In the present specification and the like, in order to simplify and clarify the explanation, an axial direction of a crankshaft 2 is defined as an up-down direction (first direction), a direction which is perpendicular to the up-down direction and in which a cylinder portion 1*b* extends is defined as a front-back direction (second direction), and a direction perpendicular to the up-down direction and the front-back direction is defined as a left-right direction. In the drawing, the front of the engine E is shown as Fr, the rear as Rr, the left as L, the right as R, the upper as U, and the lower as D.

Figure 2:
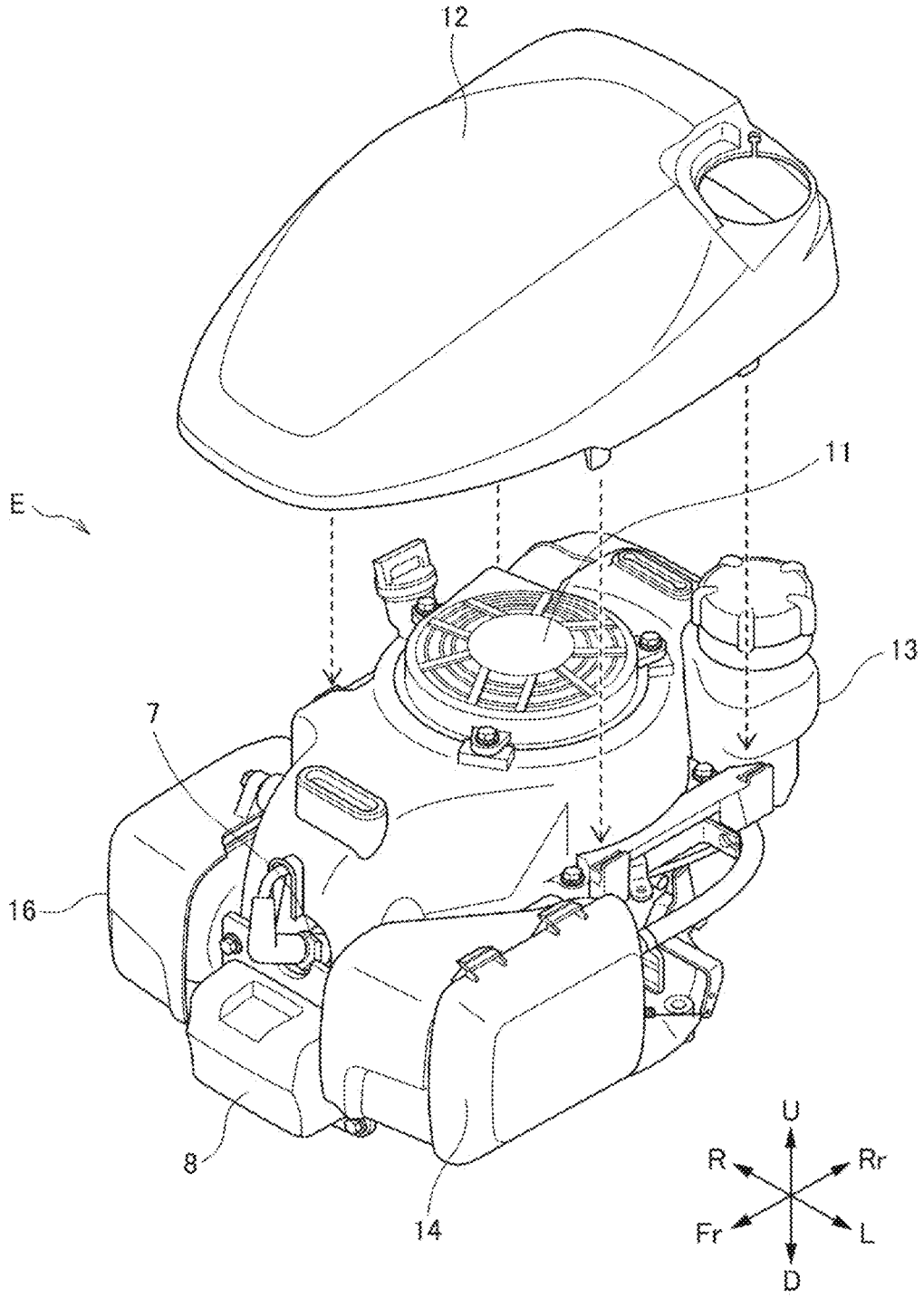
FIG. 2 is a perspective view of the engine with a top cover removed, as viewed from diagonally above and front.
Figure 3:
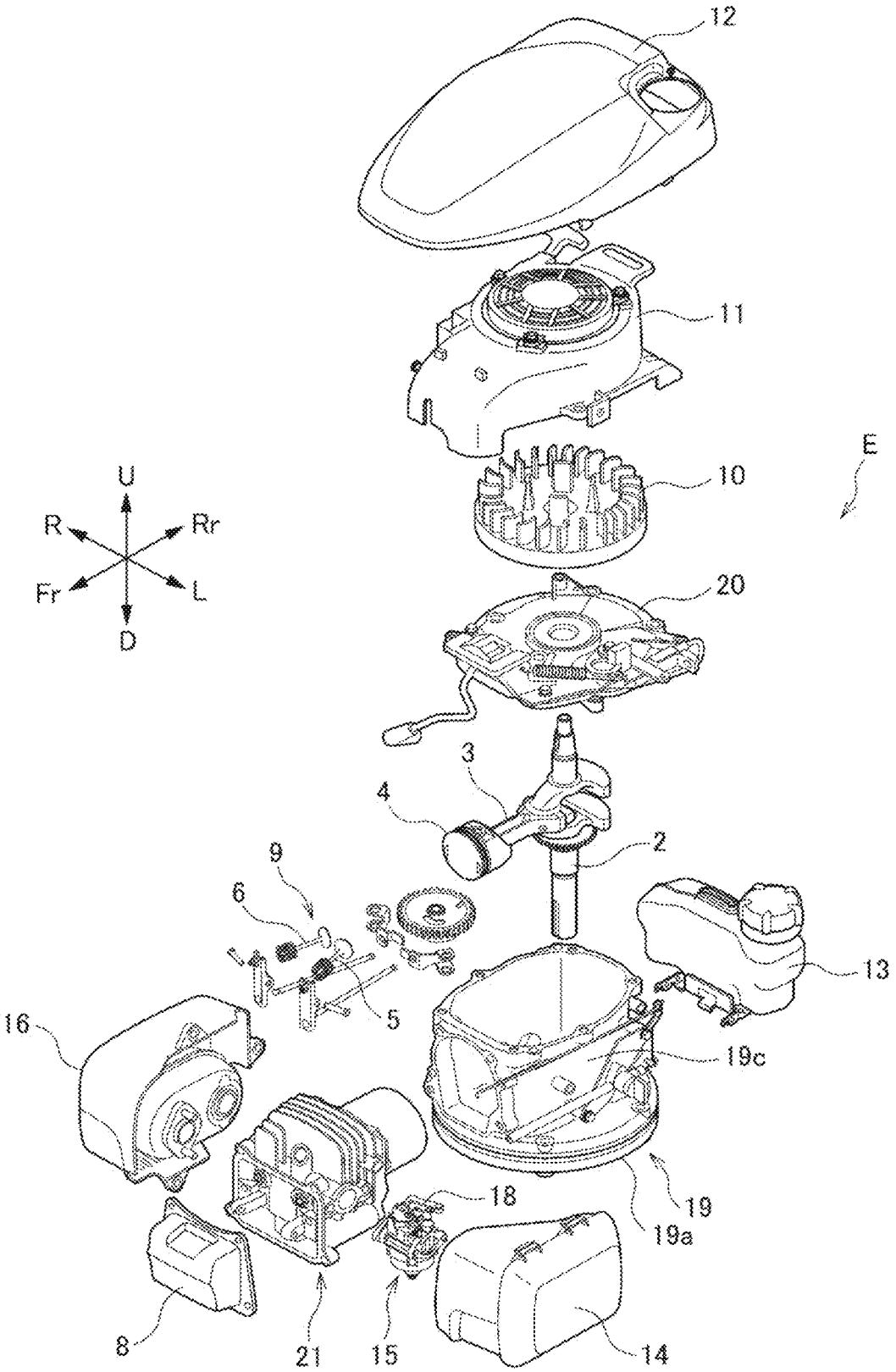
FIG. 3 is an exploded perspective view of the engine as seen from diagonally above and front.

As illustrated in FIGS. 1 to 3, the engine E of the embodiment includes an engine body 1 including a crankcase portion 1*a* and the cylinder portion 1*b*, the crankshaft 2 which is rotatably supported by the crankcase portion 1*a* in the up-down direction, a piston 4 slidably fitted in the cylinder portion 1*b* and connected to the crankshaft 2 via a connecting rod 3, an intake valve 5, an exhaust valve 6, and a spark plug 7 provided in a head portion 1*e* of the cylinder portion 1*b*, ahead cover 8 for covering the head portion 1*c* of the cylinder portion 1*b*, a valve mechanism 9 which operates the intake valve 5 and the exhaust valve 6 according to the rotation of the crankshaft 2, a flywheel 10 connected to an upper end of the crankshaft 2, a recoil starter 11 which is placed above the flywheel 10 and starts the engine E, a top cover 12 which covers the top of engine E, a fuel tank 13 for storing fuel, an air cleaner 14 which purifies the air, a carburetor 15 which produces and supplies a mixture of fuel and air to the cylinder portion 1*b*, a muffler 16 which exhausts the exhaust gas from the cylinder portion 1*b* while muffling the gas, a governor mechanism 17 (see FIGS. 5 and 6) which automatically opens and closes a throttle valve (not illustrated) of the carburetor 15 according to the rotation speed of the crankshaft 2, and an auto choke mechanism 18 which automatically opens and closes the throttle valve of the carburetor 15 according to the temperature of the engine body 1.

[Engine Body]

Figure 4:
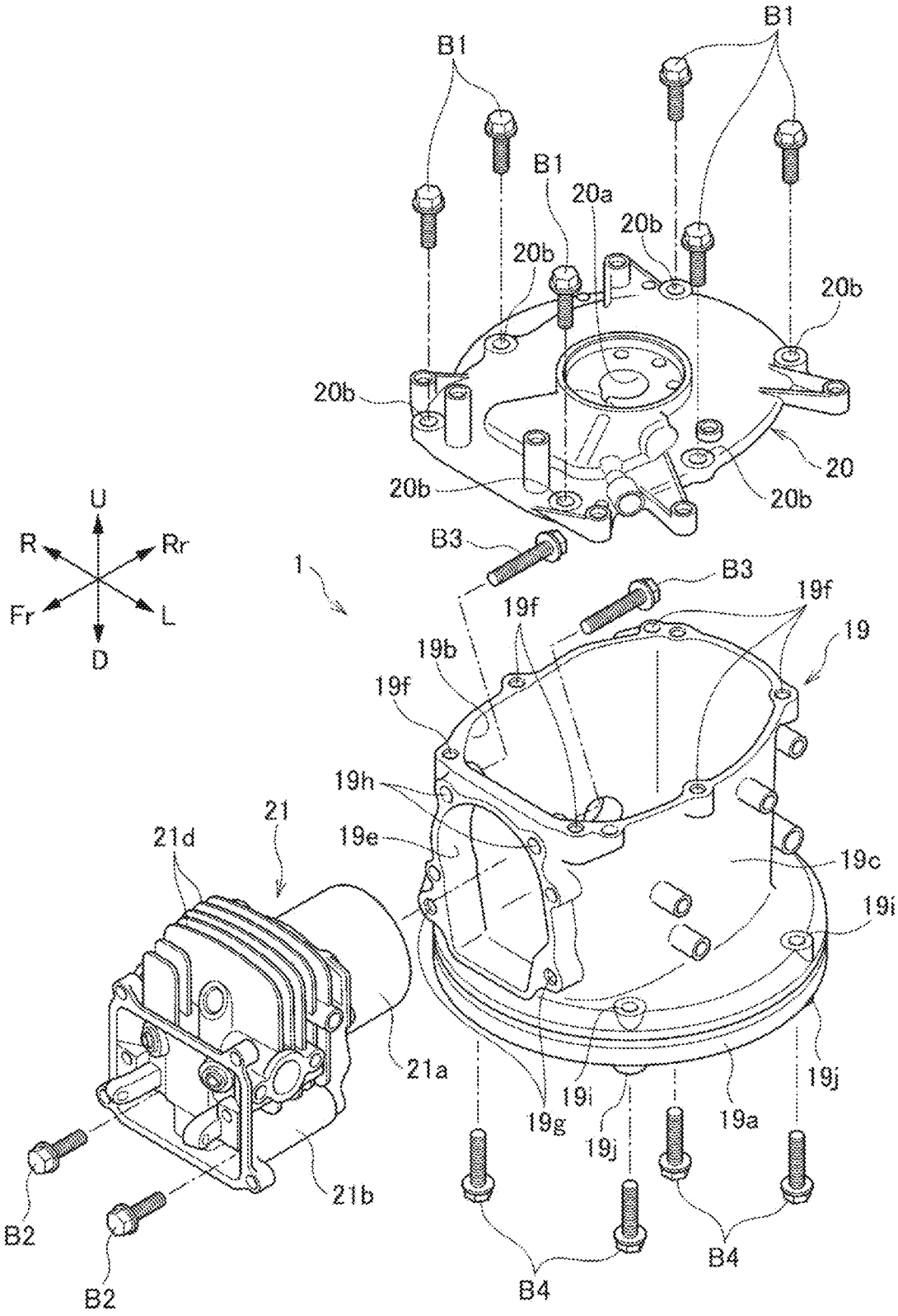
FIG. 4 is an exploded perspective view of an engine body as viewed from diagonally above and front.

As illustrated in FIG. 4, the engine body 1 includes a crankcase body 19, a crankcase cover 20, and a cylinder unit 21.

Figure 5:
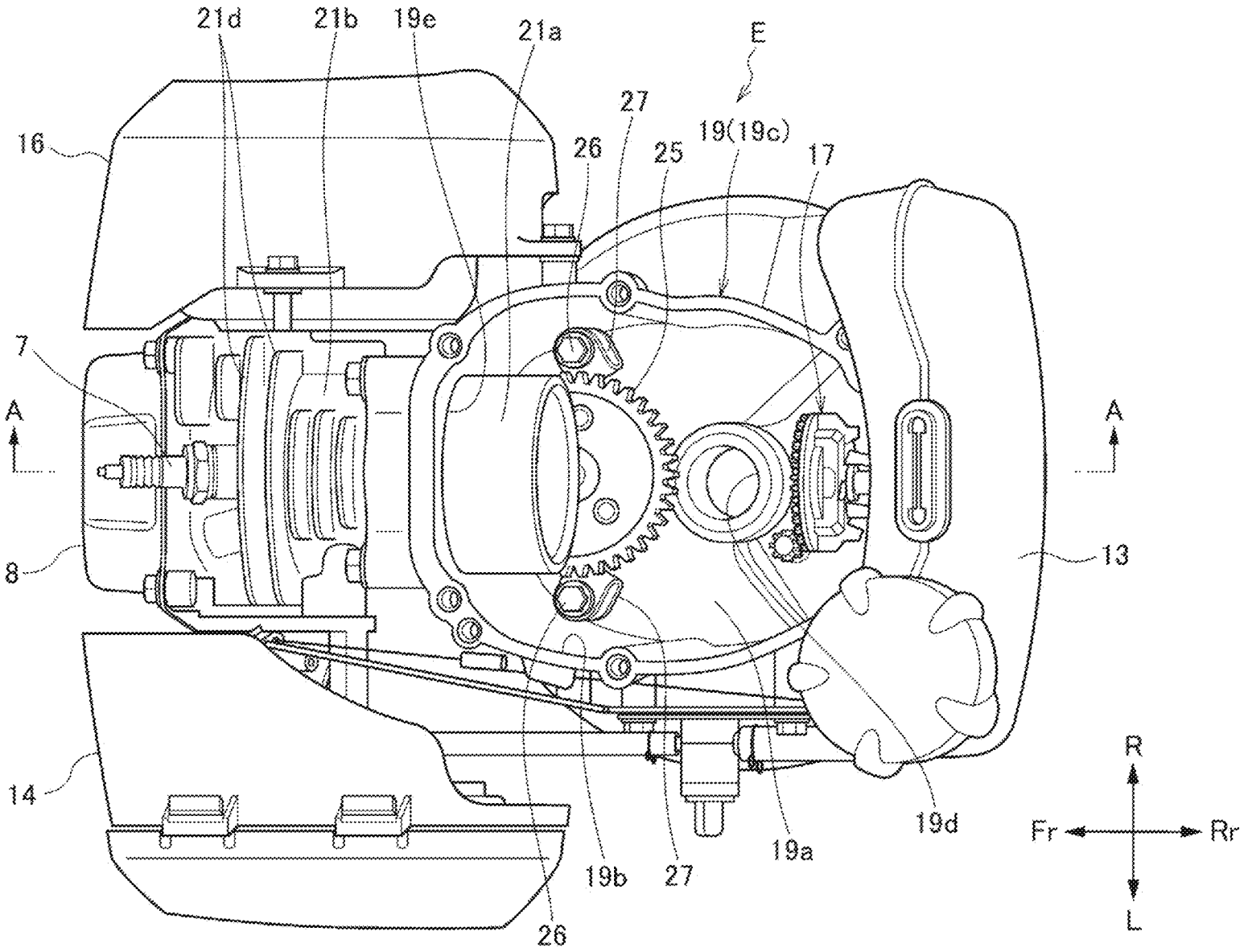
FIG. 5 is a plan view of the engine with a crankcase cover removed.
Figure 6:
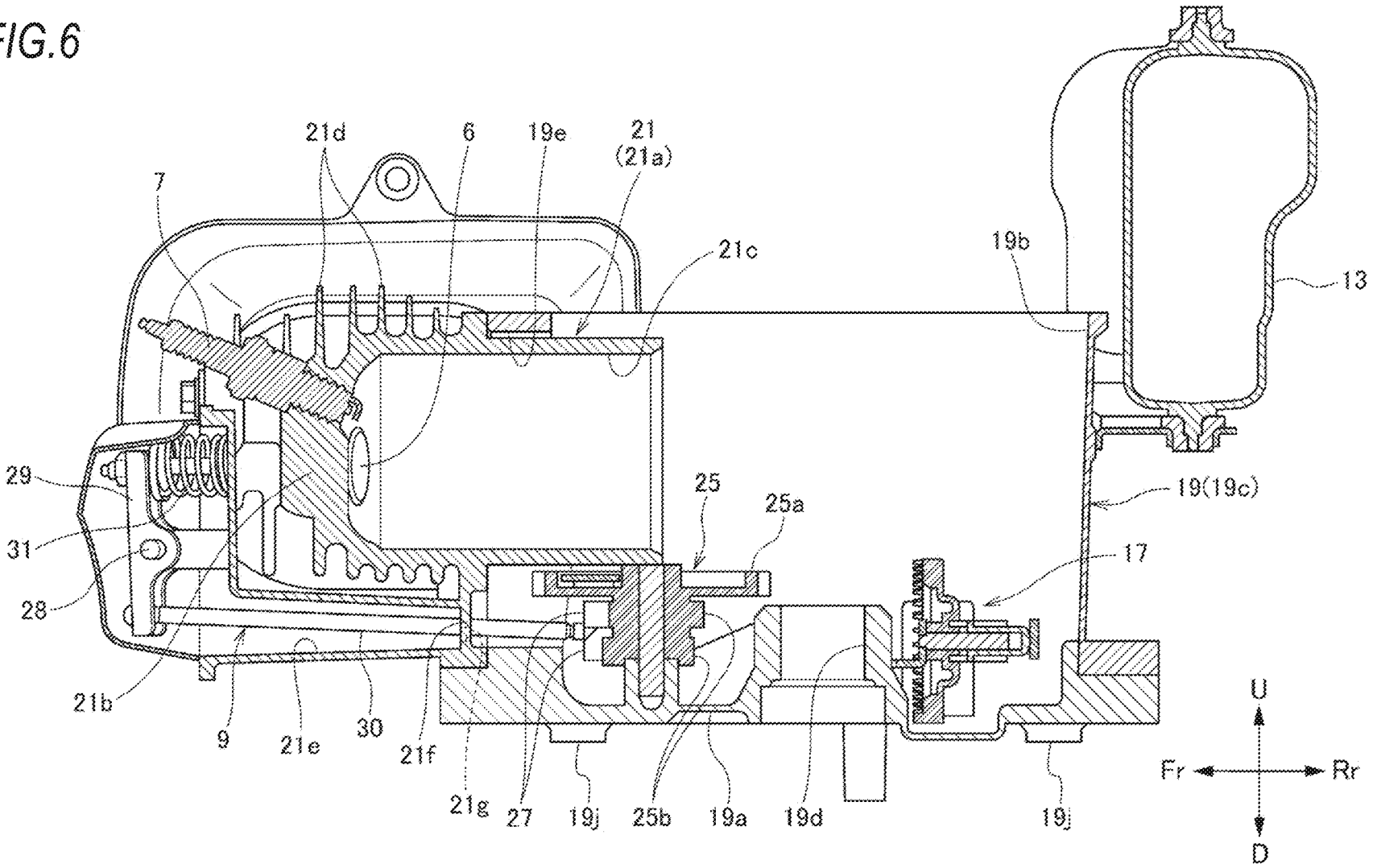
FIG. 6 is a cross-sectional view taken along the line A-A of FIG. 5.

As illustrated in FIGS. 4 to 6, the crankcase body 19 includes a bottom plate 19*a* and a tubular portion 19*c* including a case opening portion 19*b* on a side opposite to the bottom plate 19*a*. A first crankshaft insertion hole 19*d* through which the lower end side of the crankshaft 2 is inserted is formed in the center of the bottom plate 19*a* and a cylinder insertion hole 19*e* through which the cylinder base portion 21*a* of the cylinder unit 21 is inserted is formed in the front surface of the tubular portion 19*c*.

The bottom plate 19*a* is detachably attached to the lower end of the tubular portion 19*c* via a plurality of bolts B4. Specifically, the lower end of the tubular portion 19*c* is formed with a plurality of bolt fastening holes 19*i* through which the bolts B4 are inserted from below and the bottom plate 19*a* is formed with a plurality of bolt insertion holes 19*j* into which the bolts B4 are fastened from below. The bottom plate 19*a* is attached to the tubular portion 19*c* by fastening the bolts B4 to the bolt fastening holes 19*i* via the bolt insertion holes 19*j*. Conversely, the bottom plate 19*a* can be removed from the tubular portion 19*c* by releasing the fastening of the bolts B4 to the bolt fastening holes 19*i*.

As illustrated in FIG. 4, the crankcase cover 20 covers the case opening portion 19*b* of the crankcase main body 19 and forms the crankcase portion 1*a* of the engine body 1 together with the crankcase main body 19. A second crankshaft insertion hole 20*a* into which the upper end of the crankshaft 2 is inserted is formed in the center of the crankcase cover 20. The crankshaft 2 is rotatably supported between a second bearing 22 provided adjacent to the second crankshaft insertion hole 20*a* of the crankcase cover 20 and a first bearing 23 provided adjacent to the first crankshaft insertion hole 19*d* of the crankcase body 19.

The crankcase cover 20 is detachably attached to the upper end of the crankcase body 19 via a plurality of bolts B. Specifically, a plurality of bolt insertion holes 20*b*, through which the bolts B1 are inserted from above, are formed in the peripheral portion of the crankcase cover 20 and a plurality of bolt fastening holes 19*f* into which the bolts B1 are fastened from above are formed in the upper end of the crankcase body 19. The crankcase cover 20 is attached to the crankcase body 19 by fastening the bolts B1 to the bolt fastening holes 19*f* through the bolt insertion holes 20*b*. Conversely, the crankcase cover 20 can be removed from the crankcase body 19 by releasing the fastening of the bolts B1 from the bolt fastening holes 19*f*.

As illustrated in FIGS. 4 to 6, the cylinder unit 21 includes the cylinder base portion 21*a* which is inserted into the cylinder insertion hole 19*e* of the crankcase body 19 from the front and is located inside the crankcase body 19 and a cylinder block 21*b* which extends forward from the cylinder base portion 21*a* and is located outside the crankcase body 19. The cylinder unit 21 alone forms the cylinder portion 1*b* of the engine body 1 and the front end of the cylinder block 21*b* forms the head portion 1*c*. The cylinder base portion 21*a* and an inner peripheral surface of a cylindrical portion of the cylinder block 21*b* form a cylinder bore 21*c* which is a sliding surface with the piston 4 and a large number of cooling fins 21*d* are provided on the outer peripheral portion of the cylinder block 21*b*.

According to such cylinder unit 21, by preparing a plurality of types of cylinder unit 21 having different bore diameters, it becomes possible to provide an engine E having a different displacement simply by replacing the cylinder unit 21 while making the crankcase body 19 and the crankcase cover 20 common.

The cylinder unit 21 is detachably attached to the crankcase body 19 via a plurality of bolts B2 and B3. For example, when a plurality of bolt insertion holes (not illustrated) through which the bolts B2 are inserted from the front are formed at the rear end of the cylinder block 21*b* and a plurality of bolt fastening holes 19*g* for fastening the bolts B2 from the front are formed at the front end of the crankcase body 19, by fastening the bolts B2 to the bolt fastening holes 19*g* through the bolt insertion holes of the cylinder block 21*b*, the cylinder unit 21 can be attached to the crankcase body 19. Conversely, by releasing the fastening of the bolts B2 to the bolt fastening holes 19*g*, the cylinder unit 21 can be removed from the crankcase body 19.

However, in the engine body 1 of the embodiment, when the cylinder unit 21 is detachably attached to the crankcase body 19 via the plurality of bolts B2 and B3, the bolts B3 on the upper end side is fastened to the cylinder unit 21 from the inside of the crankcase body 19. Specifically, a plurality of bolt insertion holes 19*h* through which the bolts B3 are inserted from the inside of the crankcase body 19 toward the front are formed in the front end of the crankcase body 19 and a plurality of bolt fastening holes (not illustrated) for fastening the bolts B3 from the rear are formed at the rear end of the cylinder block 21*b*, and further the bolts B3 is fastened to the bolt fastening holes of the cylinder block 21*b* through the bolt insertion holes 19*h* of the crankcase body 19.

According to such a mounting structure of the cylinder unit 21, since it is not necessary to form a space for fastening the bolts B3 from the front side at least on the upper end side of the cylinder block 21*b*, the cylinder unit 21 can be attached to the crankcase body 19 without disturbing the external structure (for example, the cooling fin 21*d*) of the cylinder block 21*b*, and thus the cooling performance of the engine E can be improved.

[Valve Mechanism]

Figure 7:
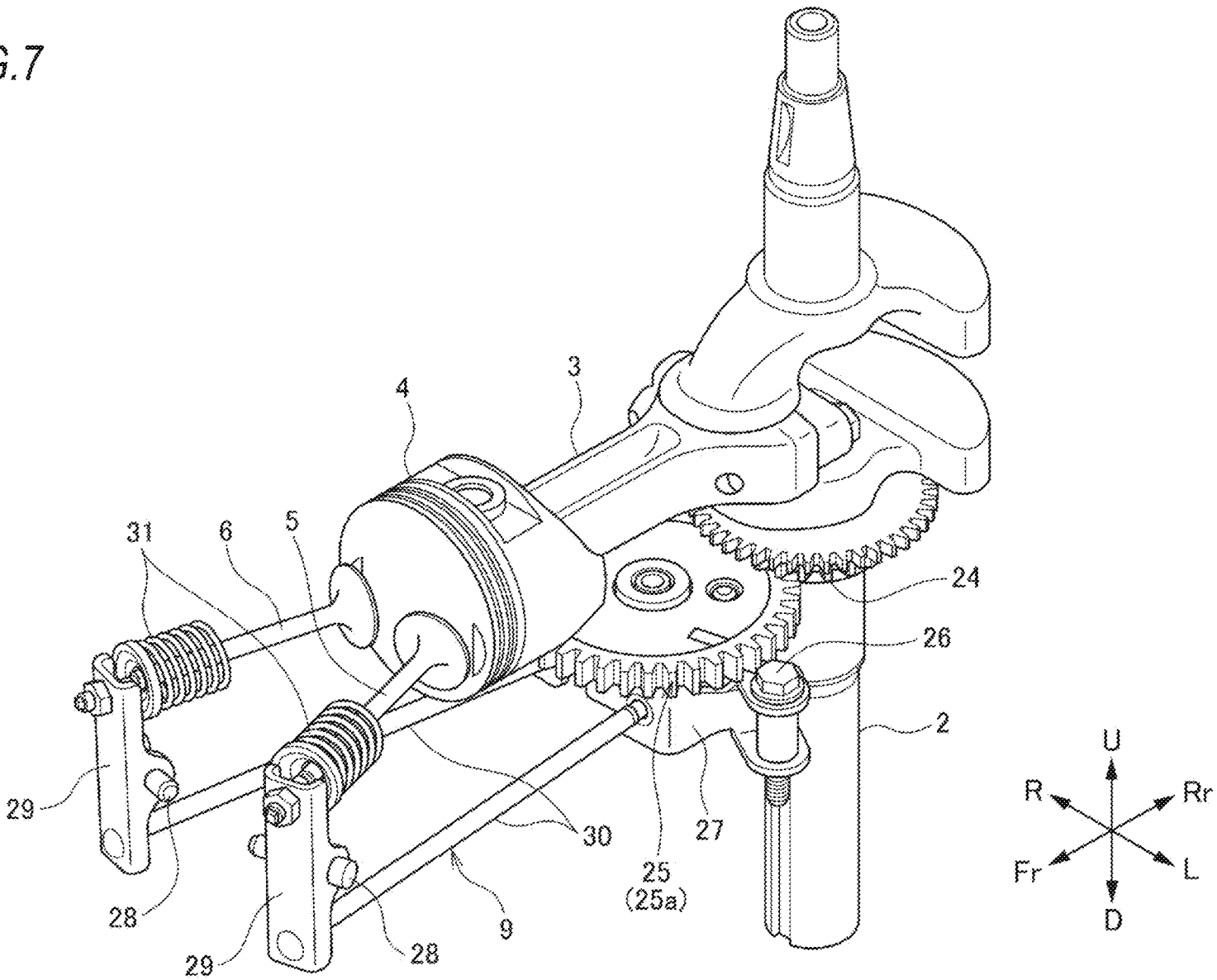
FIG. 7 is a perspective view of a valve mechanism of the engine as viewed from diagonally above and front.
Figure 8:
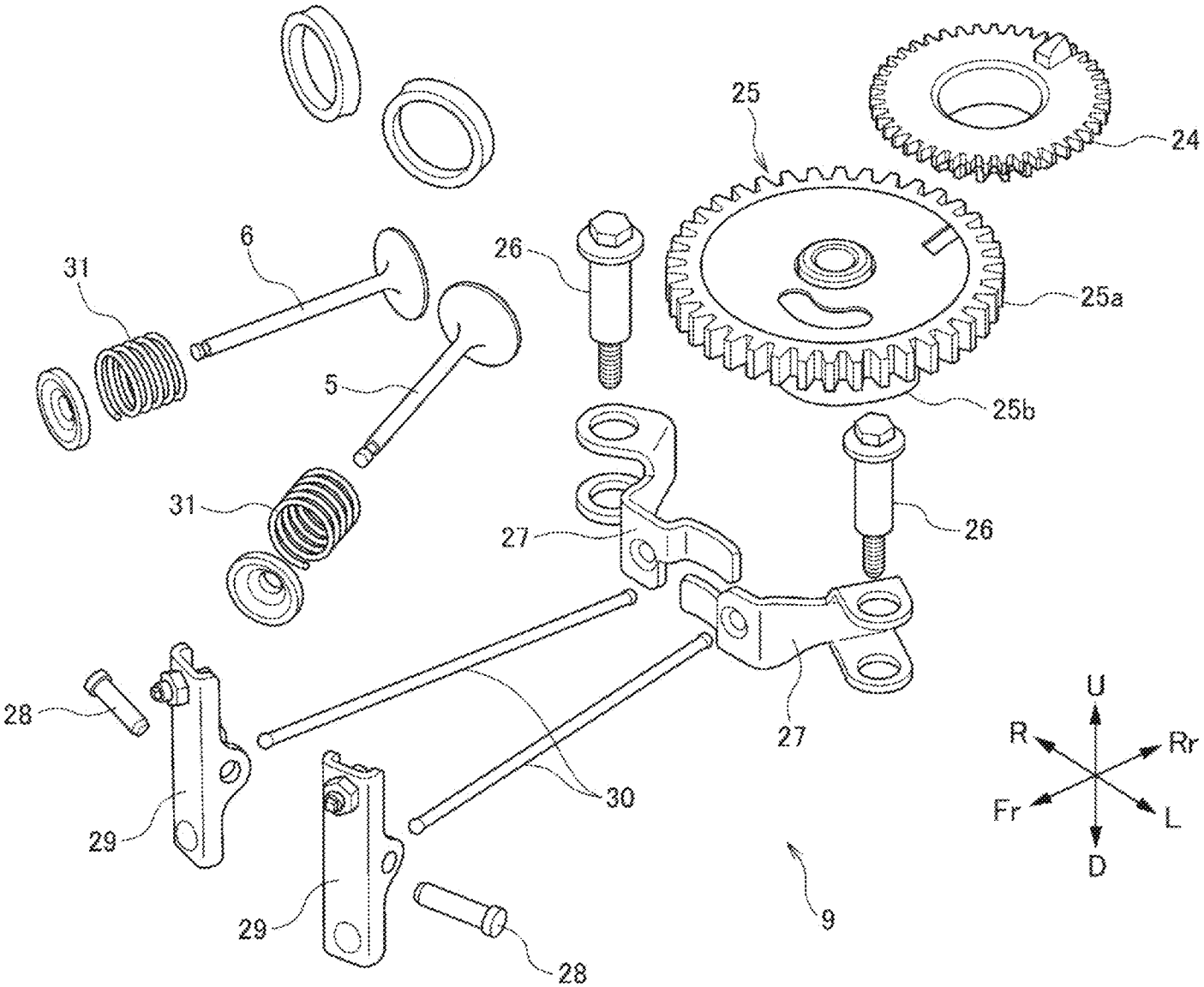
FIG. 8 is an exploded perspective view of the valve mechanism of the engine as viewed from diagonally above and front.

As illustrated in FIGS. 6 to 8, the valve mechanism 9 includes a timing gear 24 fixed to the crankshaft 2, a camshaft 25 rotatably supported on the bottom plate 19*a* of the crankcase body 19, a pair of lifters 27 supported to be swingable on the bottom plate 19*a* of the crankcase body 19 via stepped bolts 26, a pair of rocker arms 29 which are supported to be swingable at the front end of the cylinder block 21*b* via rocker arm shafts 28 and one end of which abuts the front end of the intake valve 5 or the exhaust valve 6, a pair of push rods 30 which are accommodated in a push rod accommodation portion 21*e* formed in the lower part of the cylinder unit 21 and which respectively connect the lifters 27 to the other end portions of the pair of rocker arms 29, and a pair of valve springs 31 for urging the intake valve 5 and the exhaust valve 6 in a closing direction.

A camshaft 25 includes a gear portion 25*a* which meshes with the timing gear 24 and is rotationally driven by the timing gear 24 at a speed reduction ratio of ½ and a cam portion 25*b* which alternately pushes the pair of lifters 27 according to the rotational drive of the gear portion 25*a*. When the cam portion 25*b* pushes the lifter 27, the other end of the corresponding rocker arm 29 is pushed through the push rod 30 and the intake valve 5 or the exhaust valve 6 connected to one end of the rocker arm 29 is opened.

Conversely, when the pushing of the lifter 27 by the cam portion 25*b* is released, the intake valve 5 or the exhaust valve 6 is closed by the urging force of the valve spring 31.

The camshaft 25 of the embodiment is arranged below the cylinder base portion 21*a* of the cylinder unit 21. When the camshaft 25 is arranged as such, it is possible to access the inside of the crankcase body 19 from the top without removing the camshaft 25 by simply removing the crankcase cover 20 when maintaining the engine E.

However, in the arrangement configuration in which the camshaft 25 is arranged below the cylinder base portion 21*a* of the cylinder unit 21, that is, between the bottom plate 19*a* and the cylinder base portion 21*a*, particularly, in the arrangement configuration in which the cylinder base portion 21*a* of the cylinder unit 21 overlaps above the camshaft 25 as seen from the case opening portion 19*b* of the crankcase body 19, access to the camshaft 25 is blocked by the cylinder base portion 21*a* of the cylinder unit 21, and thus the maintainability and assembly of the valve mechanism 9 including the camshaft 25 may deteriorate.

As described above, the crankcase body 19 of the embodiment is formed by dividing the bottom plate 19*a* and the tubular portion 19*c* and the bottom plate 19*a* and the tubular portion 19*c* are detachably attached.

According to such a crankcase body 19, even when the cylinder unit 21 is not removed, it is possible to easily access the camshaft 25 by removing the bottom plate 19*a* from the tubular portion 19*c*. Therefore, the maintainability and assembly of the valve mechanism 9 including the camshaft 25 can be improved.

In the embodiment, since the crankcase cover 20 is also detachably attached to the crankcase body 19, it is possible to access the inside of the crankcase body 19 from the top by removing the crankcase cover 20 during maintenance of the engine E. In particular, when replacing the crankshaft 2, it is possible to easily replace the crankshaft 2 by removing the crankcase cover 20 and pulling out the crankshaft 2.

The embodiment described above can be appropriately modified, improved, and the like. For example, in the embodiment described above, the crankcase cover 20 is attachable to and detachable from the crankcase body 19, but the crankcase cover 20 may be formed integrally with the crankcase body 19.

SUMMARY

At least the following matters are described in the specification. Although the constituent elements and the like corresponding to those of the embodiment described above are shown in parentheses, the invention is not limited thereto.

(1) An engine (engine E) which includes:

a crankcase body (crankcase body 19) including a bottom plate (bottom plate 19*a*) including a first crankshaft insertion hole (first crankshaft insertion hole 19*d*) and a tubular portion (tubular portion 19*c*) including a case opening portion (case opening portion 19*b*) on an opposite side to the bottom plate;

a crankcase cover (crankcase cover 20) including a second crankshaft insertion hole (second crankshaft insertion hole 20*a*) and covering the case opening portion of the crankcase body;

a crankshaft (crankshaft 2) which is inserted into the first crankshaft insertion hole and the second crankshaft insertion hole:

a cylinder base portion (cylinder base portion 21*a*) located inside the crankcase body;

a cylinder block (cylinder block 21*b*) located outside the crankcase body; and a camshaft (camshaft 25) disposed inside the crankcase body and between the bottom plate and the cylinder base portion, where the crankcase body has the bottom plate detachably attached to the tubular portion.

According to (1), since the bottom plate of the crankcase body is detachably attached to the tubular portion, by removing the bottom plate from the tubular portion during maintenance, it is possible to easily replace the camshaft inside the crankcase without removing the crankshaft.

(2) The engine according to (1), where the crankcase cover is detachably attached to the crankcase body.

According to (2), the crankcase cover is detachably attached to the crankcase body. Therefore, even when the crankcase cover is removed, it is possible to access the inside of the crankcase. As a result, the maintainability is improved.

(3) The engine according to (1) or (2), where the cylinder base portion overlaps with at least a part of the camshaft as seen from the case opening portion.

According to (3), the cylinder base portion overlaps with at least a part of the camshaft as seen from the case opening portion. Therefore, it is easier to replace the camshaft or the like by removing the bottom portion than removing the crankcase cover.

(4) The engine according to any one of (1) to (3), where the cylinder base portion and the cylinder block form a cylinder unit (cylinder unit 21), and the cylinder unit is detachably attached to the crankcase body.

According to (4), since the cylinder unit is detachably attached to the crankcase body, for example, the camshaft can be replaced by removing the crankcase cover and cylinder unit. Since the cylinder unit is detachably attached to the crankcase body, it is possible to provide an engine body with a different displacement by simply replacing the cylinder unit.

(5) The engine according to any one of (1) to (4), where the engine includes a valve mechanism (valve mechanism 9), the valve mechanism includes, a timing gear (timing gear 24) fixed to the crankshaft, the camshaft rotatably supported by the bottom plate of the crankcase body, a pair of lifters (lifters 27) supported to be swingable on the bottom plate of the crankcase body.

a pair of rocker arms (rocker arms 29) which are supported to be swingable via rocker arm shafts (rocker arm shafts 28) and one end of which abuts against an intake valve (intake valve 5) or an exhaust valve (exhaust valve 6), a pair of push rods (push rods 30) for connecting the pair of lifters to the other ends of the pair of rocker arms, and a pair of valve springs (valve springs 31) for urging the intake valve and the exhaust valve in a closing direction, and the pair of push rods are accommodated in a push rod accommodation portion (push rod accommodation portion 21*e*) formed in the cylinder block.

According to (5), the pair of push rods of the valve mechanism are accommodated in the push rod accommodation portion formed in the cylinder block. Therefore, it is possible to access the valve mechanism simply by removing the bottom plate when maintaining the engine. Since the push rod accommodation portion is formed integrally with the cylinder block, the number of parts can be reduced. As a result, the manufacturing cost can be reduced.

DESCRIPTION OF REFERENCE NUMERALS AND CHARACTERS

E: engine
2: crankshaft
5: intake valve
6: exhaust valve
9: valve mechanism
19: crankcase body
19*a*: bottom plate
19*b*: case opening portion
19*c*: tubular portion
19*d*: first crankshaft insertion hole
20: crankcase cover
20*a*: second crankshaft insertion hole
21: cylinder unit
21*a*: cylinder base portion
21*b*: cylinder block
21*e*: push rod accommodation portion
24: timing gear
25: camshaft
27: lifter
28: rocker arm shaft
29: rocker arm
30: push rod
31: valve spring

The invention claimed is:

1. An engine comprising:

a crankcase body including a bottom plate including a first crankshaft insertion hole and a tubular portion including a case opening portion on an opposite side to the bottom plate;

a crankcase cover including a second crankshaft insertion hole and covering the case opening portion of the crankcase body;

a crankshaft which is inserted into the first crankshaft insertion hole and the second crankshaft insertion hole;

a cylinder base portion located inside the crankcase body;

a cylinder block located outside the crankcase body; and a camshaft disposed inside the crankcase body and between the bottom plate and the cylinder base portion, wherein the crankcase body has the bottom plate detachably attached to the tubular portion, a shaft portion of the camshaft is positioned between the cylinder base portion and the bottom plate, and the shaft portion of the camshaft is positioned to be pressed from above by the cylinder base portion when viewed from the upper side of the case opening portion, and the bottom plate is configured to axially support the shaft portion of the camshaft.

2. The engine according to claim 1, wherein the crankcase cover is detachably attached to the crankcase body.

3. The engine according to claim 1, wherein the cylinder base portion overlaps with at least a part of the camshaft as seen from the case opening portion.

4. The engine according to claim 1, wherein:

the cylinder base portion and the cylinder block form a cylinder unit; and the cylinder unit is detachably attached to the crankcase body.

5. The engine according to claim 1, wherein:

the engine includes a valve mechanism;

the valve mechanism includes:

a timing gear fixed to the crankshaft;

the camshaft rotatably supported by the bottom plate of the crankcase body;

a pair of lifters supported to be swingable on the bottom plate of the crankcase body;

a pair of rocker arms which are supported to be swingable via rocker arm shafts and one end of which abuts against an intake valve or an exhaust valve;

a pair of push rods for connecting the pair of lifters to the other ends of the pair of rocker arms; and a pair of valve springs for urging the intake valve and the exhaust valve in a closing direction; and the pair of push rods are accommodated in a push rod accommodation portion formed in the cylinder block.

* * * * *